United States Patent [19]

Meeks et al.

[11] Patent Number: 5,032,352

[45] Date of Patent: Jul. 16, 1991

[54] COMPOSITE BODY FORMATION OF CONSOLIDATED POWDER METAL PART

[75] Inventors: Henry S. Meeks, Roseville; Stephen P. Swinney, Rancho Cordova, both of Calif.

[73] Assignee: Ceracon, Inc., Sacramento, Calif.

[21] Appl. No.: 585,885

[22] Filed: Sep. 21, 1990

[51] Int. Cl.[5] ..... B22F 7/00

[52] U.S. Cl. ..... 419/8; 419/16; 419/38; 419/42; 419/49; 419/66; 419/68; 264/60; 264/65; 264/125

[58] Field of Search ..... 419/8, 18, 38, 42, 49, 419/68, 66

[56] References Cited

U.S. PATENT DOCUMENTS

| | | | |
|---|---|---|---|
| Re. 32,389 | 4/1987 | Becker et al. | 419/8 |
| 4,104,787 | 8/1978 | Jandeska | 75/226 |
| 4,477,955 | 10/1984 | Becker et al. | 419/8 |
| 4,499,048 | 2/1985 | Hanejko | 419/49 |
| 4,499,049 | 2/1985 | Hanejko | 419/49 |
| 4,501,718 | 2/1985 | Bradt | 419/49 |
| 4,537,097 | 8/1985 | Illerhaus et al. | 419/8 |
| 4,539,175 | 9/1985 | Lichti et al. | 419/49 |
| 4,562,892 | 1/1986 | Ecer | 175/371 |
| 4,597,456 | 7/1986 | Ecer | 175/371 |
| 4,640,711 | 2/1987 | Lichti et al. | 75/248 |
| 4,861,546 | 8/1989 | Friedman | 419/8 |

*Primary Examiner*—Stephen J. Lechert, Jr.
*Attorney, Agent, or Firm*—William W. Haefliger

[57] ABSTRACT

The method of consolidating a powder material to form a composite part includes forming a pattern which is a scaled-up version of the part to be formed; employing the pattern to produce a flexible mold with interior conformation matching the pattern exterior; introducing a previously formed shape, insert or body into the mold; introducing consolidatable powder material into the mold; compacting the mold to thereby compress the powder and previously formed shape into a preform which is to be consolidated; separating the preform from the mold; providing a bed of pressure transmission particles, and positioning the preform in the bed; and compacting the preform in the bed of particles by transmission of pressure to the preform via the bed, to thereby consolidate the preform into a dense, desired shape part.

10 Claims, 3 Drawing Sheets

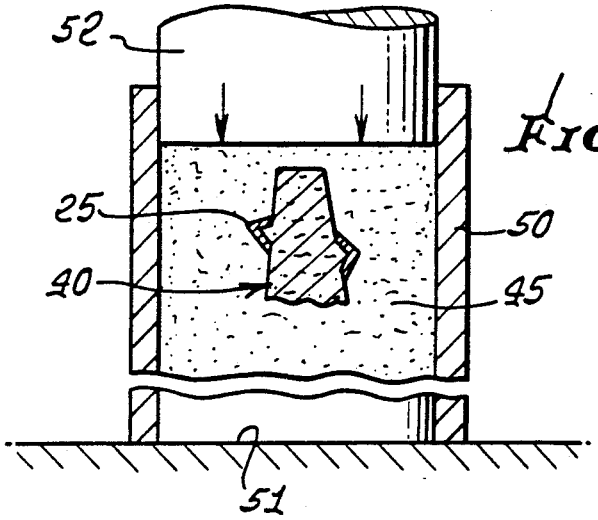
FIG. 6.
FIG. 7.
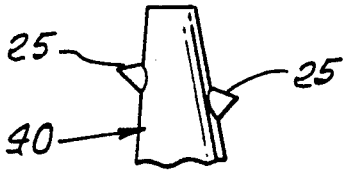
FIG. 8.
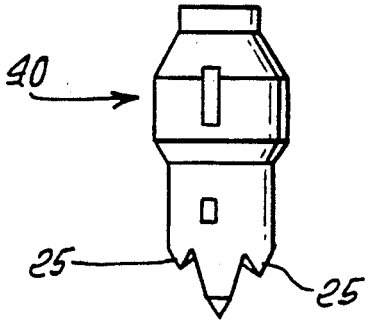
FIG. 9.
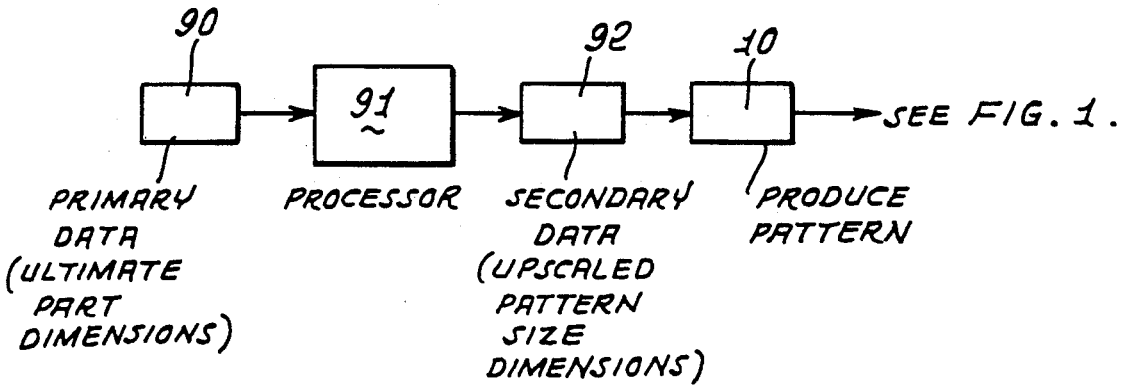

COMPOSITE BODY FORMATION OF CONSOLIDATED POWDER METAL PART

BACKGROUND OF THE INVENTION

This invention relates generally to powder preform consolidation processes, and more particularly to such processes wherein consolidated parts are composite bodies having complex shapes.

There is continuing need for simple, effective, powder material consolidation techniques, particularly where the parts to be processed have complex interior or exterior configurations comprising different material compositions, one example being drill bits wherein complex cutter projections are required. This becomes critically difficult when the cutters constitute a very hard material which is different in composition from the main body of the drill bit to be consolidated from metal powder.

SUMMARY OF THE INVENTION

It is a major object of the invention to provide an improved process meeting the above need. This objective is exemplified by the presently disclosed process for bonding a previously formed shape or insert (for example a cutter) to loose consolidatable powder, in an isostatic or semi-isostatic pressing system or process. An example is the combining of a formed metal, ceramic, plastic or inorganic material shape or insert with a powdered material, by placement adjacent to or within the powdered material and subjection to consolidation pressures to both consolidate the part body to be produced and to bond the shape or insert to the body, during consolidation.

As will be seen, the process of the invention includes the use of a flexible mold, and includes the steps:

a) forming a pattern which is a scaled-up version of the part to be formed, b) employing the pattern to produce a flexible mold with interior conformation matching the pattern exterior, c) introducing a previously formed shape, insert, or other material into the mold at the desired location(s), d) introducing consolidatable powder material into the mold, e) compacting the mold to thereby compress the powder into a composite preform which is to be consolidated, f) separating the preform from the mold, g) providing a bed of pressure transmission particles, fluid, gas or other body and positioning the preform in said bed, h) compacting the preform in the bed of particles by transmission of pressure to the preform via said bed, to thereby consolidate the preform into a dense, desired shape part.

As will be seen, an insert, inserts, or other body(s) may be added or combined with the mold to be in contact with the powder during compression to form the preform, or it may be added to the formed preform, to be consolidated therewith. One or more such inserts or formed shapes may be provided to form a complex structure when consolidated, and the insert or inserts may be hollow to receive powder to be consolidated to lock the insert or inserts to the part body, as during consolidation. In this regard, the ultimate part may comprise a drill bit wherein the inserts form complex cutter configurations.

It is another object of the invention to achieve scale up of the part to be produced, in order to form the mold producing pattern, as by use of software for dimensionally defining the part by primary data storage, and including processing such data to produce secondary data which defines the up-scaled version, and employing such secondary data to produce the pattern.

These and other objects and advantages of the invention, as well as the details of an illustrative embodiment, will be more fully understood from the following specification and drawings, in which:

DRAWING DESCRIPTION

FIG. 6 is a view like FIG. 5 showing the consolidated preform in the die;

FIG. 7 shows a consolidated preform, with inserts, after removal from the die;

FIG. 8 shows an actual drill bit formed by the process; and

FIG. 9 is a software use flow diagram to produce a pattern as referred to.

DETAILED DESCRIPTION

Figure 1:
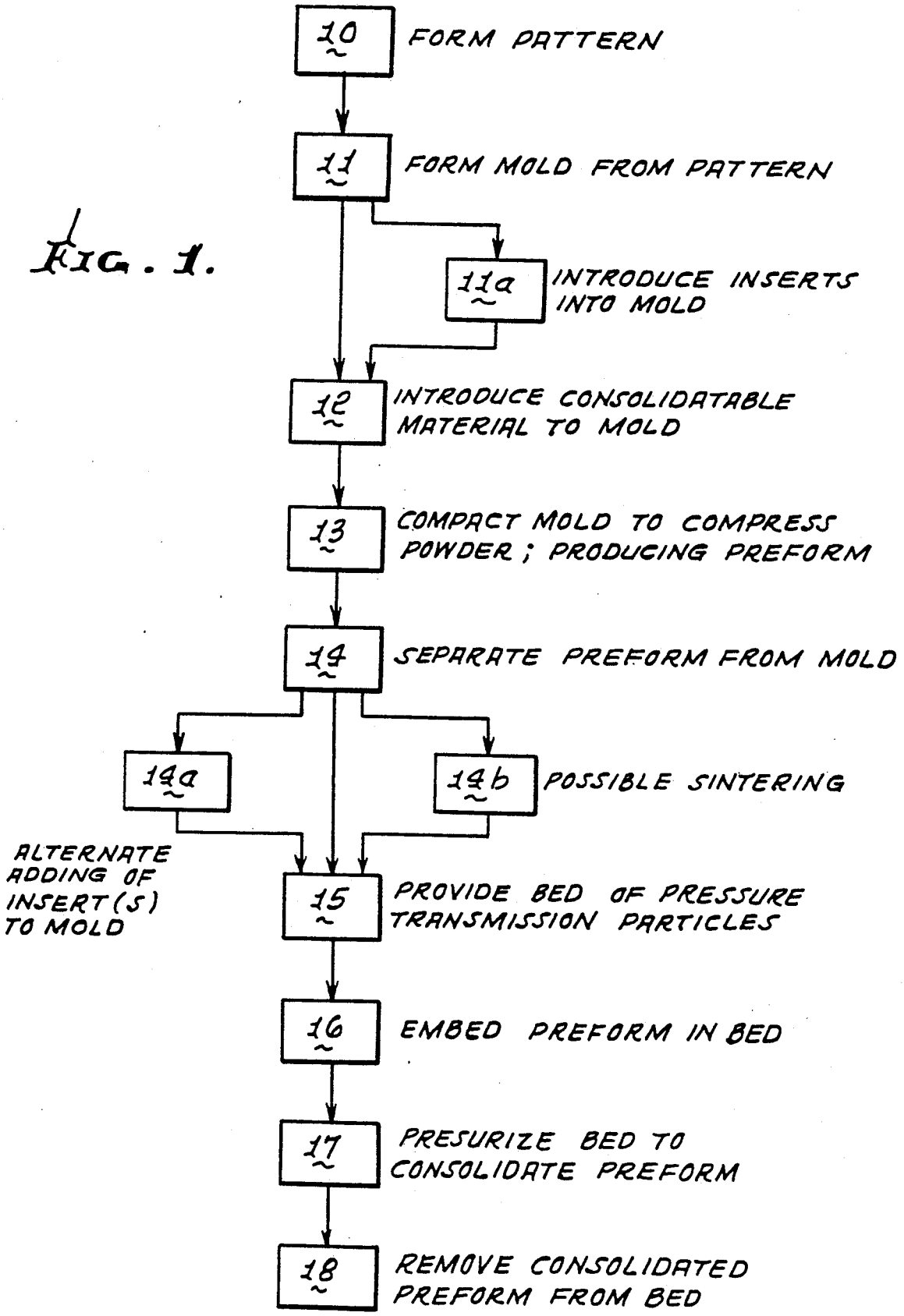
FIG. 1 is a flow diagram.
Figure 2:
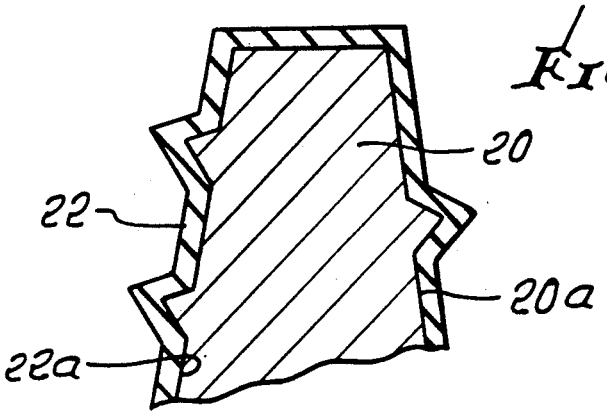
FIG. 2 is a section showing mold formation from a pattern.

Referring to FIG. 1, the process includes forming a pattern, which may for example be a scaled-up version of the part ultimately to be produced. This step is indicated at 10. FIG. 2 shows a representative pattern 20, which may for example be constructed of wood or other material, and its exterior surface 20*a* constitutes a scaled-up (in size) version of a part ultimately to be produced, such a consolidated part indicated at 40 in FIG. 7. Step 11 in FIG. 1 constitutes formation of a mold by utilization of the pattern; and FIG. 2 also shows the forming of a thin-walled flexible mold 22 to the pattern surface 20*a*. That mold may consist of rubber or other elastomeric material, suitably conformed to the mold surface. The latter may be a mold interior surface instead of the exterior surface as shown. Note mold interior surface 22*a* precisely conforming to the pattern exterior surface.

Step 11*a* constitutes the introduction of a previously formed shape, insert or other body into the mold. The shapes may be specifically or randomly placed within the mold.

Figure 3:
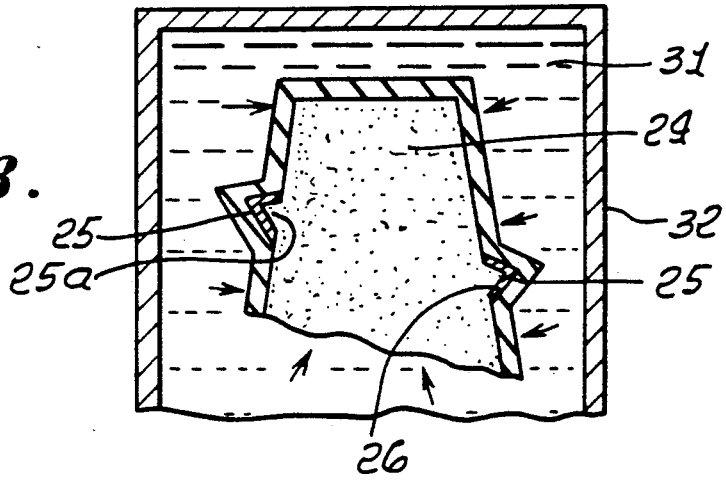
FIG. 3 is a section showing forming of a preform using a mold, and inserts in the mold.

Step 12 of the process constitutes introduction of consolidatable powder material to the mold, as for example introducing such powder 24 into the mold interior, as seen in FIG. 3. Such powder may be metallic, ceramic, or mixtures of same, as well as other powders or mixtures. Examples are powdered steel particles, aluminum, alumina, silicon and the like. Prior to such powder introduction to the mold, an insert, inserts, or other body(s) may be added to the mold, as for example as noted by step 11*a* in FIG. 1, and by the hollow inserts 25 added to the mold as viewed in FIG. 3. In the example, the part to be produced is a drill bit, and the inserts 25 have cutter configuration, i.e. form projections that are received into recesses 26 formed in the mold by the pattern. The hollow interiors 25a of the cutters are presented inwardly, to be filled with powder material 24, as shown. Such cutters may consist of hard material as described in U.S. Pat. Nos. 4,597,456 and 4,562,892 to Ecer, for example. STELLITE, or tungstun carbide are examples. The inserts may otherwise consist of preformed metal powder, slurry, composite material, sintered material or previously formed body(s), to be ultimately consolidated. The powder 24 may have a composition as disclosed in those patents, or other compositions.

Figure 4:
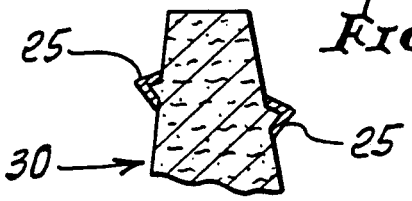
FIG. 4 is an elevation showing a formed preform.

Step 13 of the process as indicated in FIG. 1 constitutes compacting the mold, with the powder, inserts, or other body(s) therein, to produce a powder preform 30, seen in FIG. 4 as separated from the mold. FIG. 3 shows an example of pressure transmission to the mold, as via liquid 31, or grain or particles, extending about the mold, as within a pressure chamber 32. A preform typically is about 80-85% of theoretical density, but other densities are possible. Note in FIG. 4 the inserts 25 adherant to the preform, and presented outwardly. The step of separating the preform from the mold is indicated at 14 in FIG. 1.

The preform may then be sintered as indicated at 14b in FIG. 1 in order to increase its strength, or the preform may be directly processed by step 15. Sintering of steel preforms is typically carried out at temperatures in the range of about 2,000° to 2,300° F., for a time of about 2–30 minutes, in a protective atmosphere. An example of a protective, non-oxidizing, inert atmosphere is nitrogen, or nitrogen-based. Subsequent to sintering, the preforms can be stored, for later processing. If that is the case, the preform may be re-heated in a protective atmosphere for subsequent processing, as for example to at least about 1,950° F.

Inserts or bodies 25 may be added or attached to the preform at this stage, if desired, and their depiction in FIG. 4 can represent this step, otherwise indicated at 14a in FIG. 1.

Figure 5:
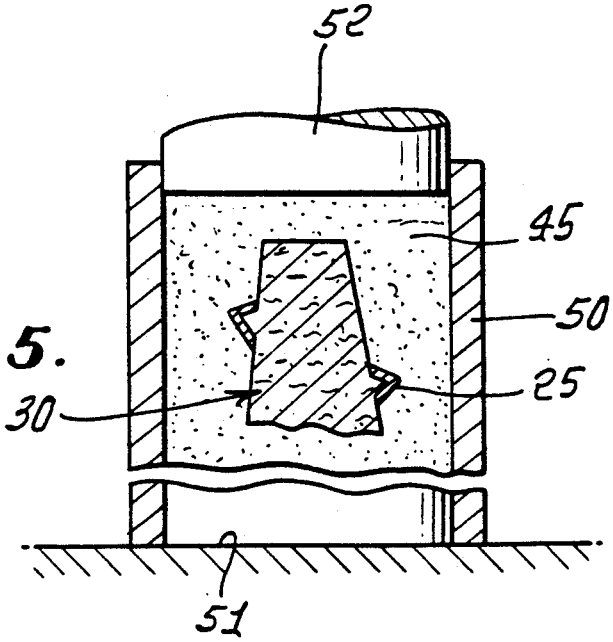
FIG. 5 is a section showing the preform with inserts thereon in a grain bed in a consolidation die.

Steps 15–18 in FIG. 1 have to do with consolidation of the preforms 30, in a bed of pressure transmitting particles, as for example in the manner disclosed in any of U.S. Pat. Nos. 4,499,048; 4,499,049; 4,501,718; 4,539,175; and 4,640,711, the disclosures of which are incorporated herein by reference. Thus, step 15 comprises provision of the bed of particles (carbonaceous, ceramic, or other materials or mixtures thereof) as seen at 45 in FIG. 5; step 16 comprises embedding of the preform in the particle bed, which may be pre-heated, as the preform may be; step 17 comprise pressurizing the bed to consolidate the preform; and step 18 refers to removing the consolidated preform from the bed. See consolidation die 50 in FIG. 5, press bed 51 (bottom platen), hydraulic press ram 52 exerting pressure on the bed particles which distribute the applied pressure substantially uniformly to the preform. The preform is typically at a temperature between 1,000° F. and 4,000° F. prior to consolidation (and preferably between 1,700° F. and 4,000° F.). The embedded powder preform is compressed under high uniaxial pressure exerted by the ram, in the die, to consolidate the preform to up to full theoretical density. It is also a possibility of the present invention to consolidate to less than full density. If the inserts or body(s) 25 consist of consolidatable powder, they too are consolidated. In all cases, they bond to the consolidated part 40. FIG. 6 shows the formed part 40 in the die 50, prior to removal, and removal of particles or grain 45 off the part. FIG. 7 shows the completed part, which may be a drill bit with cutters 25. FIG. 8 shows an actual drill bit.

In FIG. 9, primary data 90 is software data defining the ultimate consolidated part dimensions. That data is processed at 91 to produce secondary data 92 that defines an up-scaled pattern dimensions. Data 92 is used to produce the pattern at 10, for use in the FIG. 1 process.

Consolidatable powder other than metallic or ceramic may be employed. One example is a metal matrix composite consisting of an aluminum or steel substance which contains a dispersoid of dissimilar composition.

PROCESS EXAMPLE I

A silicon rubber elastomeric bag (mold) having a varying wall thickness of 0.100 to 2.00 inches, with an internal cavity volume of 716 cubic centimeters was fitted with formed metal caps (inserts) made by a metal injection molding technique. The caps occupy tooth-like external projections inside the bag. Such caps were made from a metal matrix composite of steel and sintered cemented tungsten carbide pellets. The steel had a composition consisting of, by weight, 0.5% molybdenum, 0.35% manganese,, 0.40% carbon, 1.8% nickel, and the balance iron. The second component in the composite was a sintered tungsten carbide pellet of the composition, by weight, 6% cobalt, 94% tungsten carbide. The pellet diameters vary between 0.010 inches and 0.040 inches.

The two metals were mixed together and blended with a polymeric or organic binder (methyl cellulose) and injected into the cap mold. The cap mold had a shape conforming to the cavity in the elastomer rubber mold, and was approximately 1.250 inches long, 1 inch high, and had 0.070 inch wall thickness. The walls of the cap form a "V" shape at an included angle of approximately 40 degrees. The shaped caps were then inserted into nineteen(19) cavities in the elastomer mold in preparation to receive the main metal powder charge.

Twelve and one half pounds (12.5 lbs) of a low alloy steel powder of the matrix composition previously described, was poured into the elastomeric mold and temporarily secured the caps in place. An overlapping closure was placed over the fill opening and 28 inches of vacuum was drawn on the assembly. The vacuum nipple was then pinched off, sealing the assembly.

The evacuated and sealed elastomer bag was then placed into a high pressure water vessel and pressure consolidated at room temperature to 40,000 psi, thereby cold welding the individual powder particles and molded caps together to form an integral body of less than full density.

The next step involved removing the integral body from the elastomeric bag and heating it to at least 2000° F. At the same time a carbonaceous pressure transmitting medium (grain) was heated to 2000° F. The integral body and PTM were placed via robot into a straight walled die and pressure applied to the PTM via a downward moving punch until 25 tons per square inch pressure was achieved. The integral body was held at this pressure for 20 seconds and then removed. Consolidation to full theoretical density was confirmed by metallographic examination. The densified composite body was found to have attained a near-net shape, unitary body of superior quality.

Significant advantages over prior art include, but are not limited to, net/near net shape fabrication of a composite body and total elimination of the non-homogeneous inferior weld zone or "hard metal zone", on the tooth surfaces.

We claim:

1. The method of consolidating a powder material to form a part that includes:

a) forming a pattern which is a scaled-up version of the part to be formed, b) employing said pattern to produce a flexible mold with interior conformation matching the pattern exterior, c) introducing a previously formed insert means into the mold, d) introducing consolidatable powder material into said mold, e) compacting said mold to thereby compress said previously formed insert means and the consolidatable powder into a preform which is to be consolidated, f) separating the preform from the mold, g) providing a bed of pressure transmission particles, and positioning said preform in said bed, h) compacting said preform in said bed of particles by transmission of pressure to the preform via said bed, to thereby consolidate said preform into a dense, desired shape part, and to bond said insert means to the consolidated powder material.

2. The method of claim 1 including adding the previously formed insert means into said mold to be in contact with said powder during said step e).

3. The method of claim 2 wherein said insert mean is a unitary insert or body in contact with the mold during said step e).

4. The method of claim 3 wherein said insert mean is hollow, and including the step of filling powder into the insert means hollow to be compacted therein during said steps e) and h).

5. The method of claim 4 wherein said insert mean is a hard, metallic, ceramic or other body to be retained to said part as a result of said steps e) and h).

6. The method of claim 5 wherein said part formed by said step h) is a drill bit, and said steps e) and h) are carried out to maintain said hard, metallic body exposed proximate the surface of the bit.

7. The method of claim 2 wherein said insert means comprises multiple inserts.

8. The method of claim 1 including dimensionally defining said part by primary data storage, and including processing said data to secondary data which defines said up-scale version, and employing said secondary data to produce said pattern.

9. The method of consolidating a powder material to form a part that includes:

a) forming a pattern which is a scaled-up version of the part to be formed, b) employing said pattern to produce a flexible mold with interior conformation matching the pattern exterior, c) introducing a previously formed insert means into the mold, d) introducing consolidatable powder material into said mold, e) compacting said mold to thereby compress said previously formed insert means and the consolidatable powder into a preform which is to be consolidated, f) separating the preform from the mold, g) compacting said preform by transmission of pressure to the preform to thereby condolidate said preform into a dense, desired shape part, and to bond said insert means to the consolidated powder material.

10. The method of claim 1 including adding the previously formed insert means into said mold to be in contact with said powder during said step e).

* * * * *